United States Patent [19]

Kent

[11] Patent Number: 4,875,248

[45] Date of Patent: Oct. 24, 1989

[54] ADJUSTABLE TOOTHBRUSH

[75] Inventor: Steven Kent, Stockport, England

[73] Assignee: Colgate-Palmolive Company, Piscataway, N.J.

[21] Appl. No.: 172,033

[22] Filed: Mar. 23, 1988

[51] Int. Cl.[4] ..... A46B 7/02; B25G 1/06

[52] U.S. Cl. ..... 15/143 R; 15/167.1; 15/172; 15/176.1; 403/84

[58] Field of Search ..... 15/167.1, 167.2, 143 R, 15/144 R, 145, 176, 172, 244.2, 144 A, 144 B, 143 A, 143 B, 167.3, 176.1, 176.2, 176.3, 176.4, 176.5, 176.6; 403/84; 81/58, 177.8, 489; 401/268, 129; 16/110 R, 114 R; 132/84 R, 84 A, 84 B, 84 C, 84 D, 308, 309, 310, 311; D4/104, 138

[56] References Cited

U.S. PATENT DOCUMENTS

| | | | |
|---|---|---|---|
| 490,831 | 1/1893 | Lohers | 15/176 |
| 645,803 | 3/1900 | Good | 403/84 |
| 1,859,129 | 5/1932 | Costenbader | 15/172 |
| 2,719,998 | 10/1955 | Hibbs | 15/172 |
| 3,868,742 | 3/1975 | Brenner | 15/172 |
| 3,886,618 | 6/1975 | Paoletti | 15/167.1 X |
| 4,106,152 | 8/1978 | Hadary | 15/172 |
| 4,592,109 | 6/1986 | Borea et al. | 15/172 |

FOREIGN PATENT DOCUMENTS

| | | | |
|---|---|---|---|
| 534114 | 9/1931 | Fed. Rep. of Germany | 15/172 |
| 2081570 | 2/1982 | United Kingdom | 15/167.1 |

*Primary Examiner*—Harvey C. Hornsby
*Assistant Examiner*—Scott J. Haugland
*Attorney, Agent, or Firm*—Richard J. Ancel; Robert C. Sullivan; Robert L. Stone

[57] ABSTRACT

A toothbrush handle with a hollow area through which a rotatable shaft passes has a soft rubber member surrounding the shaft. A thumb-operated gear ring is secured to the rubber and the assembly is disposed in a chamber of the handle so that the ring is accessible through an opening in the outer shell of the handle. The inner chamber surface has teeth which engage the teeth on the ring and maintain it in place when the ring is pressed to displace the rubber and attached ring against the chamber teeth which prevents the shaft from being rotated when a desired angular positon of the handle and brush is achieved.

6 Claims, 2 Drawing Sheets

ADJUSTABLE TOOTHBRUSH

FIELD OF THE INVENTION

This invention relates to toothbrushes with adjustable brush handles.

BACKGROUND

A significant factor in the increasing expense of health-care is the cost of diseases of the teeth and gums. Considerable advances have been made in dentifrices, mouthwashes, medications and treatment modes employed in the dentist's office. However, the primary instrument for daily home care of the teeth and gums is still the conventional toothbrush which typically has a non-rotatable handle and a fixed set of bristles at one end.

The purpose of regular brushing is, of course, not only cosmetic, such as for removal of loose food debris, but also prophylatic, such as for removal of plaque, which is believed to be a source of caries, gingivitis and periodontitis (PD).

However, a conventional toothbrush is so angled that is is very difficult to use it to remove plaque from the gingival margin (GM) and sub-gingival area (SGA). Moreover, as noted in U.S. Pat. No. 4,454,623, such conventional toothbrushes have narrow handles and it is, therefore, difficult to rotate them by hand since they often slip. That Patent notes that, in order to get the bristles into the gingival crevice, they must be rotated at a forty-five degree angle (known as the Bass method) which is difficult to accomplish using such conventional toothbrushes.

SUMMARY

The object of this invention is to provide a toothbrush which has a brush head which can be changed in its angular position by simple manual operation at the handle of the brush. Indeed, the angular position can facilitate toothbrushing by individuals who are manually partially handicapped.

A further object of the invention is to provide a toothbrush with an adjustable brush head which can be adjusted to remove plaque from the SGA and GM.

Another object of the invention is to provide a large handle toothbrush that can be held in one hand and wherein the angle of the brush head can be changed by a thumb operated mechanical system incorporated in the handle.

THE DRAWINGS

DETAILED DESCRIPTION

Figure 1:
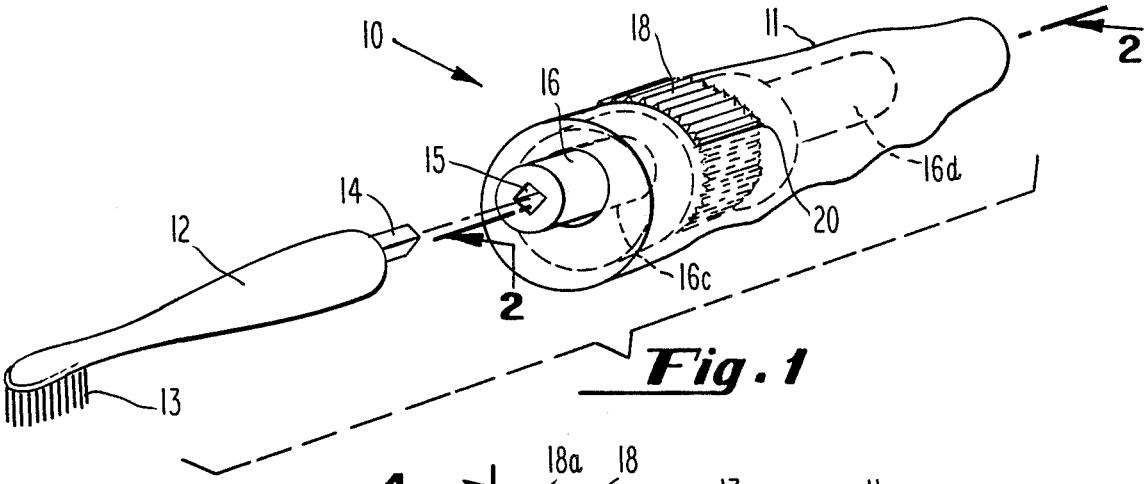
FIG. 1 is a perspective view of the toothbrush of the present invention with certain portions shown schematically.

The novel toothbrush of this invention is generally designated 10 in the drawings and includes a main body 11 which is shaped to the configuration of the palm and fingers of the hand and, as such, is much larger than conventional toothbrushes, but, being so, is more easily gripped to prevent twisting during use. The body may be made of any suitable material, preferably one of the harder injection moldable plastics.

As shown in FIG. 1, a brush handle 12 having bristles 13 at its front end has a bayonet insert 14 at its rear end designed to fit securely within a suitably shaped slot 15 formed within the front end of a shaft 16 which shaft 16 is positioned within the interior of the body 11. If desired, the handle and shaft can be an integral unit, but the preferred mode for most uses is that shown which allows replacement of brushes when old brushes become worn out.

Figure 2:
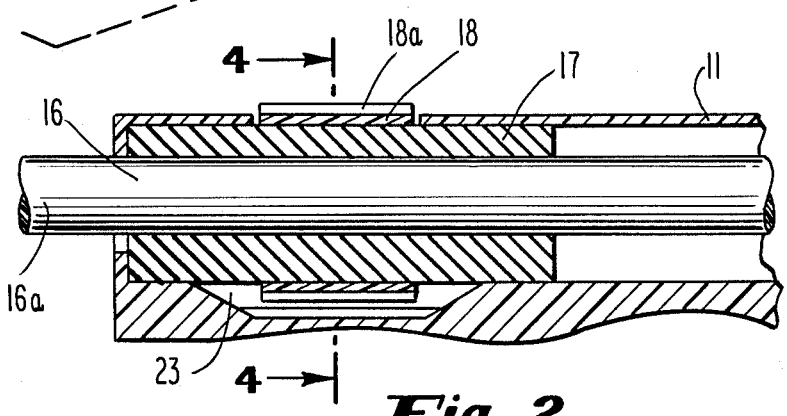
FIG. 2 is a sectional view taken along the lines 2—2 of FIG. 1.

As shown in FIG. 2, shaft 16 has a portion **16*a* surrounded by a rubber member 17 which is disposed within a chamber 23 in handle 11. Member 17** could be of material other than rubber which is deformable.

Rubber member 17 has a ring gear 18 secured to it and ring 18 has upstanding teeth **18*a***.

Figure 4:
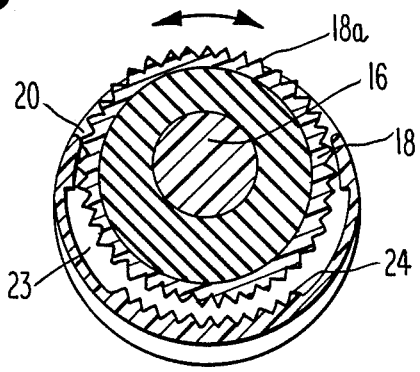
FIG. 4 is a sectional view taken along the lines 4—4 of FIG. 2.

As shown best in FIG. 4, a portion of gear ring 18 is accessible through an opening or cutout 20 of the handle 11 for manipulation by the user. (Preferably, the teeth **18*a* are relatively fine and are not raised above the surface of handle 11 so that the teeth 18*a* do not cause the user discomfort.) The rest of the ring 18 and material 17 (the "assembly") is disposed within chamber 23 located in the handle 11 below opening 20. The front part 16*c* and the rear part 16*d* of shaft 16 are supported for rotatable movement on either side of the chamber 23 by suitable bearing means within handle 11**.

In the position shown in FIGS. 2 and 4, ring 18, attached deformable member 17 and shaft 16 (to which member 18 is secured) can freely rotate within chamber 23. In this position, therefore, the user can use his thumb to rotate ring 18 which causes shaft 16 to rotate. Since brush handle 12 is fitted into shaft 16, handle 12 and, therefore, brushes 13 are moved into any desired angular position for the proper cleaning of that section of the teeth and adjacent GM and SGA.

Figure 3:
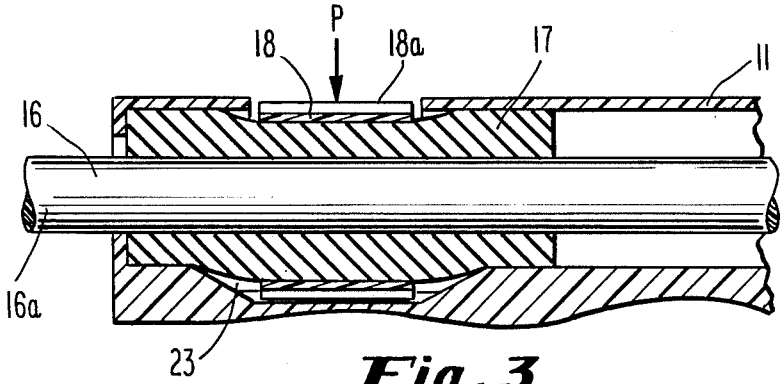
FIG. 3 is a sectional view taken along the same section as FIG. 2 but showing the rubber member deflected under pressure.

When the proper angle is achieved, the user exerts pressure downwardly on ring 18 as denoted by P in FIG. 3. This pressure causes the deformable material 17 and attached ring 18 to move down into chamber 23 so that gear teeth **18*a* engage teeth 24 disposed at the bottom of the chamber, so that shaft 16** now cannot move. At this position (the "down" position), brushing can commence at the desired brush head angle.

When a given area of the teeth and adjacent gums are thoroughly brushed, the user releases pressure (usually exerted by the thumb) on the ring 18 to allow the assembly to disengage from the teeth 24 whereby the assembly moves up to the position of FIGS. 2 and 4, thereby allowing a new angular position to be set for a different part of the teeth and adjacent gum area by repeating the angle adjustment prodedure described.

Figure 5:
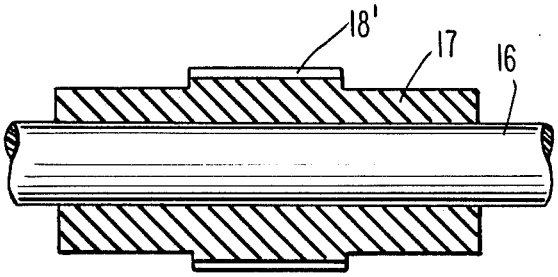
FIG. 5 is a sectional view similar to FIG. 2 showing another embodiment wherein the gear ring is an integral part of the rubber ring.

It may be desirable to form gear ring 18 as an integral part of the deformable member 17, as shown in FIG. 5 wherein ring 18' is integrally formed as a part of member 17'.

It is within the scope of this invention to make modifications of the basic concept described above.

Thus, it may be desirable to provide means for locking the assembly in the "down" position once a desired angular position of the handle and brush head are obtained, so that it is unnecesary for the user to exert constant downward thumb pressure on the gear ring.

Figure 6:
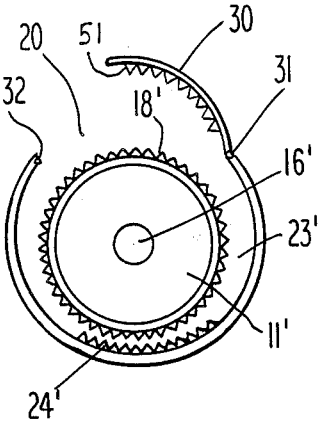
FIG. 6 is a sectional view similar to FIG. 4 of another embodiment of the invention showing a hinged hold-down catch for the gear ring in the open position.
Figure 7:
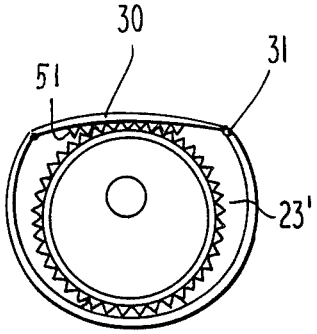
FIG. 7 is a sectional view of the device of FIG. 6 showing the hold-down catch in the closed position.

One embodiment for providing a locking means is shown in FIGS. 6 and 7 wherein parts common to those of FIGS. 1–4 are indicated by primes.

Thus, in FIG. 6 there is provided a locking member attached by a hinge 31 to the lip of cutout 20'. The user rotates ring 18' to the desired position, and then pushes the assembly down into the chamber as described to engage teeth 24'. Then, the user moves member over the opening 20' so that member 30 locks under a catch 32 disposed on the lip of the other sides of chamber 20' to maintain the assembly in the down position, as shown in FIG. 7.

Figure 8:
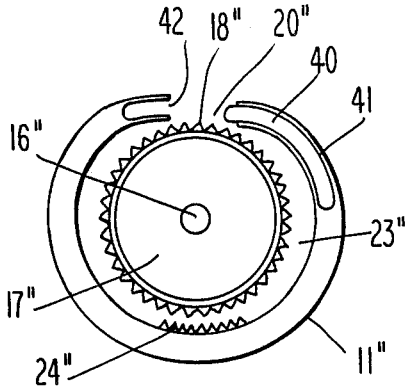
FIG. 8 is a sectional view similar to FIG. 4 showing yet another embodiment of the invention having a slide-type hold down member for the gear ring in the open position.
Figure 9:
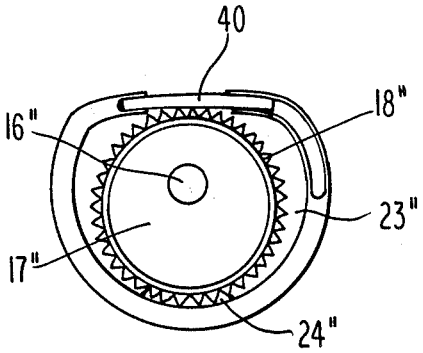
FIG. 9 is a sectional view of the device of FIG. 8 wherein the hold-down catch is in the closed position.

Another embodiment for providing a locking system is shown in FIGS. 8 and 9 wherein, again, parts common to FIGS. 1–4 are shown with a double prime. In FIG. 8 there is provided a slide lock 40 which is curved and fits within a slot 41 in the wall of handle 11''. When the lock 40 is in the open position shown in FIG. 8, the ring 18 is accessible through opening 20'' for adjustment of the assembly. When the ring 18'' is pushed down into the chamber 23'' to engage the teeth of ring 18'' with teeth 24'', the lock 40 is slided across the cutout 20'' and into a slot 42 to hold the assembly down in the locked position, whereby the shaft 16'' is maintained in the desired angular position.

Figure 10:
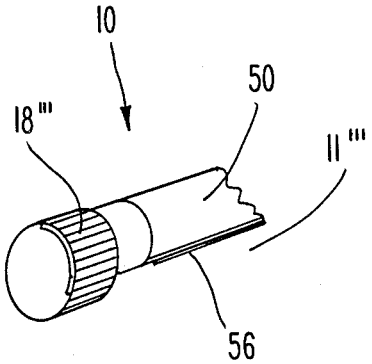
FIG. 10 is a sectional view, similar to FIG. 4 of yet another embodiment of the invention wherein the slide-type hold down member for the gear ring is slidable along the longitudinal axis of the handle.
Figure 11:
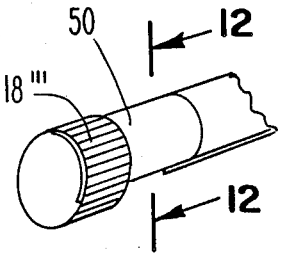
FIG. 11 is a view in section showing the hold down member of FIG. 10 moved to a position over the gear ring.
Figure 12:
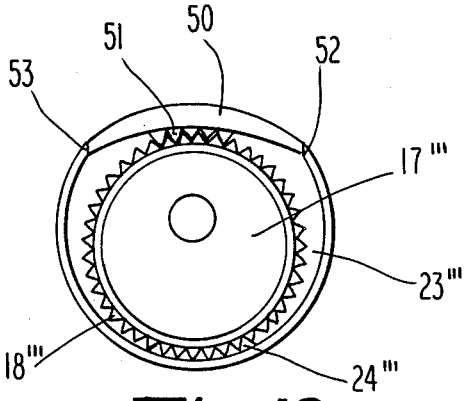
FIG. 12 is a view along the lines 12—12 of FIG. 11 showing in cross-section the engagement of the hold down member with the gear ring.

Another embodiment for providing a locking system is shown in FIGS. 10–12 wherein parts common to FIGS. 1–4 are shown in triple prime. In this embodiment, the hold down member or slide lock 50 moves along the longitudinal axis of handle 11 within a slot 56 and is movable by thumb manipulation. FIG. 12 shows lock 50 move over ring 18''' to depress it into locking engagement with teeth 24''' at the bottom of the chamber. FIG. 12 is a cross-section of FIG. 11 and shows the lock 50 over the ring. In this embodiment, lock 50 has teeth 51 which engage the teeth on ring 18'''. (It is to be noted that the locking members of the other embodiments shown and described herein, such as members 30 and 40 can also be equipped with teeth 51 to engage the teeth on ring 18.)

FIG. 12 illustrates how lock 50 is held in place by the lips 52, 53 of the groove or track 56 in which it slides.

What is claimed is:

1. An adjustable toothbrush comprising a handle, a shaft mounted for rotation within said handle and having a portion extending beyond the handle terminating in a brush head having bristles thereon, said handle having a chamber in the interior thereof, said handle having an opening to its outer surface and communicating with said chamber, said shaft passing through said chamber, deformable material in sid chamber surrounding a portion of said shaft, said deformable material having a ring gear thereon extending to the outer surface of said deformable material, said ring gear being accessible through said opening, gear teeth fixed to said handle within said chamber for meshing engagement with said ring gear, said ring gear being engageable with said gear teeth upon application of pressure on said ring gear through said opening, said ring gear being engageable with said gear teeth to prevent rotation of said shaft.

2. An adjustable toothbrush according to claim 1, wherein means are provided for locking the ring gear in engagement with said gear teeth in said chamber.

3. An adjustable toothbrush according to claim 2, wherein said locking means is hinged catch and capable of locking said ring gear in engagement with said gear teeth.

4. An adjustable toothbrush according to claim 3, wherein said locking means has teeth operable to engage said gear teeth of said ring gear.

5. An adjustable toothbrush according to claim 2, wherein said locking means is a slide mounted in said handle and capable of sliding into position to lock said ring gear into engagement with said gear teeth.

6. An adjustable toothbrush according to claim 5, wherein said locking means has teeth operable to engage said gear teeth of said ring gear.

* * * * *